US011244550B1

(12) United States Patent
Xu

(10) Patent No.: US 11,244,550 B1
(45) Date of Patent: Feb. 8, 2022

(54) PIN-TYPE ANTI-THEFT TAG WITH DOUBLE LOCKING

(71) Applicant: XUZHOU DRAGON GUARD INDUSTRIAL CO., LTD, Xuzhou (CN)

(72) Inventor: Shanshan Xu, Xuzhou (CN)

(73) Assignee: XUZHOU DRAGON GUARD INDUSTRIAL CO., LTD, Xuzhou (CN)

( * ) Notice: Subject to any disclaimer, the term of this patent is extended or adjusted under 35 U.S.C. 154(b) by 0 days.

(21) Appl. No.: 17/114,525

(22) Filed: Dec. 8, 2020

(51) Int. Cl.

| | |
|---|---|
| ***G08B 13/24*** | (2006.01) |
| ***E05B 15/08*** | (2006.01) |
| ***E05B 15/00*** | (2006.01) |
| ***E05B 73/00*** | (2006.01) |

(52) U.S. Cl.
CPC ..... *G08B 13/2434* (2013.01); *E05B 15/0073* (2013.01); *E05B 15/08* (2013.01); *E05B 73/0017* (2013.01)

(58) Field of Classification Search
CPC ..... G08B 13/2434; G08B 13/2402; E05B 73/0017
See application file for complete search history.

(56) References Cited

U.S. PATENT DOCUMENTS 6,023,951 A * 2/2000 Maurer ..... E05B 73/0052 335/306
6,449,991 B1 * 9/2002 Hogan ..... E05B 73/0017 70/57.1
2002/0171550 A1 * 11/2002 Hirose ..... E05B 47/0603 340/572.9
2004/0172989 A1 * 9/2004 Seidel ..... E05B 73/0064 70/57.1
2005/0091809 A1 * 5/2005 Xue ..... E05B 73/0064 24/704.1
2006/0174667 A1 * 8/2006 Garner ..... E05B 73/0041 70/57.1
2007/0205902 A1 * 9/2007 Cote ..... G01V 15/00 340/572.9
2009/0033497 A1 * 2/2009 Wyatt, Jr ..... E05B 73/0017 340/572.1
2009/0139279 A1 * 6/2009 Garner ..... E05B 73/0052 70/57.1
2011/0050427 A1 * 3/2011 Skjellerup ..... E05B 73/0017 340/572.8
2011/0283754 A1 * 11/2011 Ezzo ..... E05B 73/0017 70/57.1

(Continued)

*Primary Examiner* — Hoi C Lau
(74) *Attorney, Agent, or Firm* — Bayramoglu Law Offices LLC

(57) ABSTRACT

A pin-type anti-theft tag includes a safety pin, a tag body, a tag hole suitable for inserting the safety pin, at least one sensor, and a first lock body and a second lock body located in the tag body. Both the first lock body and the second lock body need to be located in a release position at the same time, so that the safety pin can be successfully removed from the tag body. The first lock body is mounted at an unlocking hole of the tag body, and a spring lock retainer is arranged at a lower portion of the first lock body. The second lock body is mounted below the tag hole of the tag body, and a pin rod of the safety pin is inserted into the second lock body along the tag hole to play a locking role.

9 Claims, 7 Drawing Sheets

(56) References Cited

U.S. PATENT DOCUMENTS

| | | | | |
|---|---|---|---|---|
| 2012/0055944 | A1* | 3/2012 | Hesch, Jr. | E05B 73/0017 220/751 |
| 2013/0141242 | A1* | 6/2013 | Ho | G08B 13/2434 340/572.1 |
| 2013/0321155 | A1* | 12/2013 | Nguyen | G08B 13/2434 340/572.8 |
| 2014/0123714 | A1* | 5/2014 | Ho | E05B 73/0005 70/57.1 |
| 2015/0262462 | A1* | 9/2015 | Nguyen | G08B 13/2434 340/572.9 |
| 2018/0197391 | A1* | 7/2018 | Luo | G08B 13/2434 |
| 2019/0027009 | A1* | 1/2019 | Miettinen | G08B 13/1463 |
| 2019/0284841 | A1* | 9/2019 | Jones | E05B 73/0017 |
| 2020/0256093 | A1* | 8/2020 | Chandramowle | E05B 73/0017 |
| 2020/0347647 | A1* | 11/2020 | Lindholm | E05B 15/04 |
| 2021/0012634 | A1* | 1/2021 | Claeys | E05B 47/0002 |

* cited by examiner

PIN-TYPE ANTI-THEFT TAG WITH DOUBLE LOCKING

TECHNICAL FIELD

The present invention relates to the field of safety anti-theft device technologies, and in particular, to a pin-type anti-theft tag with double locking.

BACKGROUND

Pin-type anti-theft tags have been widely used in retail places. At present, lock cylinders of most pin-type anti-theft tags in the market include two types, where one is a ball lock cylinder and the other is a steel sheet lock cylinder. The first one is opened using a magnetic detaching device, and the second one is opened using a mechanical lock pin. Because the two lock cylinders of pin-type anti-theft tags have been sold in the market for many years, and the detaching device of two lock cylinders of pin-type anti-theft tags can be bought easily in the market. For those who intend to steal, a universal detaching device makes theft quite easy, so the pin-type anti-theft tag cannot play an anti-theft role, and safety thereof is greatly reduced, which is not conducive to the development of the anti-theft industry.

SUMMARY

With respect to this, the present invention provides a pin-type tag with double locking, so as to solve a problem that safety of the existing pin-type anti-theft tag is greatly reduced because the tag can be easily opened with a universal detaching device.

To implement the foregoing objective, the present invention provides a following technical solution:

According to a first aspect of the present invention, a pin-type anti-theft tag with double locking is provided, where the pin-type anti-theft tag includes a safety pin;

a tag body and a tag hole suitable for inserting the safety pin;

at least one sensor;

a first lock body located in the tag body, which needs to be released by a first detaching device, where the first lock body is arranged at an unlocking hole of the tag body, and the first lock body blocks the unlocking hole when engaged, and positions and releases the unlocking hole when the first detaching device is in a release position; and a second lock body located in the tag body, which needs to be released by a second detaching device, where the second lock body is an elastic lock, the second lock body is aligned with the tag hole, and the second lock body locks the safety pin when engaged, and positions and releases the safety pin when the second detaching device is in a release position, where both the first lock body and the second lock body need to be located in the release position at the same time, so that the safety pin can be successfully removed from the tag body.

Further, the safety pin includes a pin cap and a pin rod, one end of the pin rod is connected with the pin cap, and the other end of the pin rod is inserted into the tag hole.

Further, the sensor can be freely selected from an RFID sensor, an RF sensor, an AM sensor, an EM sensor and a combination thereof.

Further, the tag body includes an upper shell and a lower shell fastened together; and the tag hole is arranged on the upper shell.

Further, the lower shell is provided with a sensor containing groove for placing the sensor.

Further, the lower shell is provided with a first lock body containing groove for placing the first lock body.

Further, the lower shell is provided with a mounting column for mounting the second lock body.

Further, the first lock body is an iron lock retainer; and a spring lock retainer is arranged below the lock retainer.

Further, the second lock body is a spring lock with a release arm.

Advantages of the present invention are as follows.

According to the pin-type anti-theft tag with double locking of the present invention, the first lock body is mounted at the unlocking hole of the tag body, and the lower portion of the first lock body is provided with the spring lock retainer, so that can effectively prevent the non-dedicated mechanical detaching device from unlocking, and can protect the pin-type anti-theft tag; and the second lock body is mounted below the tag hole of the tag body, and the pin rod of the safety pin is inserted into the second lock body along the tag hole to play a locking role. The pin-type anti-theft tag of the present invention will not be easily opened through the double function of the first lock body and the second lock body, which improves its safety in use.

BRIEF DESCRIPTION OF THE DRAWINGS

In order to more clearly illustrate the embodiments of the present invention or the technical solutions in the prior art, the following will briefly introduce the drawings that need to be used in the description of the embodiments or the prior art. Apparently, the accompanying drawings in the following description are merely exemplary, and a person of ordinary skill in the art may derive other implementation drawings from these provided accompanying drawings without creative efforts.

The structure, scale, size and others shown in this specification are only used to match the contents disclosed in this specification for those familiar with this art to understand and read, and are not intended to limit the implementation conditions of the present invention, so they do not have technical substantive significances. Any modification of structure, change of scale relationship or adjustment of size shall still fall within the scope covered by the technical contents disclosed in the present invention without affecting the efficacy and objectives that can be achieved by the present invention.

DETAILED DESCRIPTION OF THE EMBODIMENTS

Figure 1:
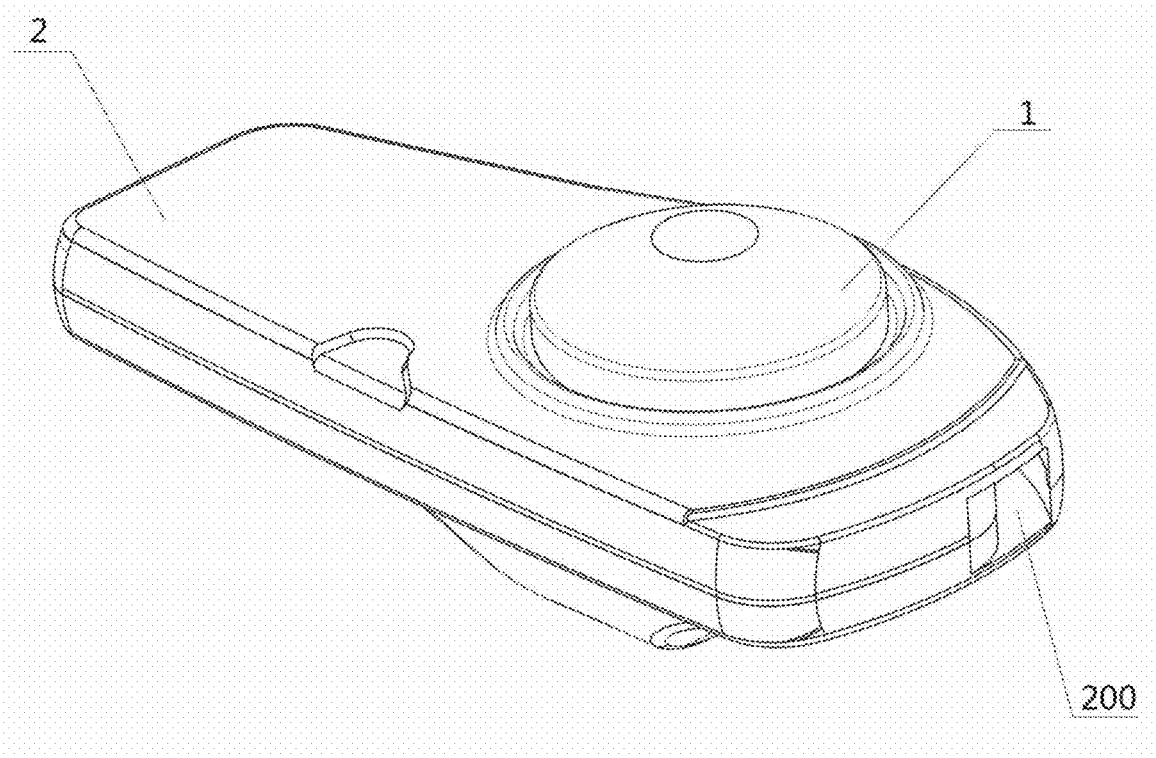
FIG. 1 is a schematic three-dimensional structural diagram of a pin-type anti-theft tag with double locking provided by the present invention.
Figure 2:
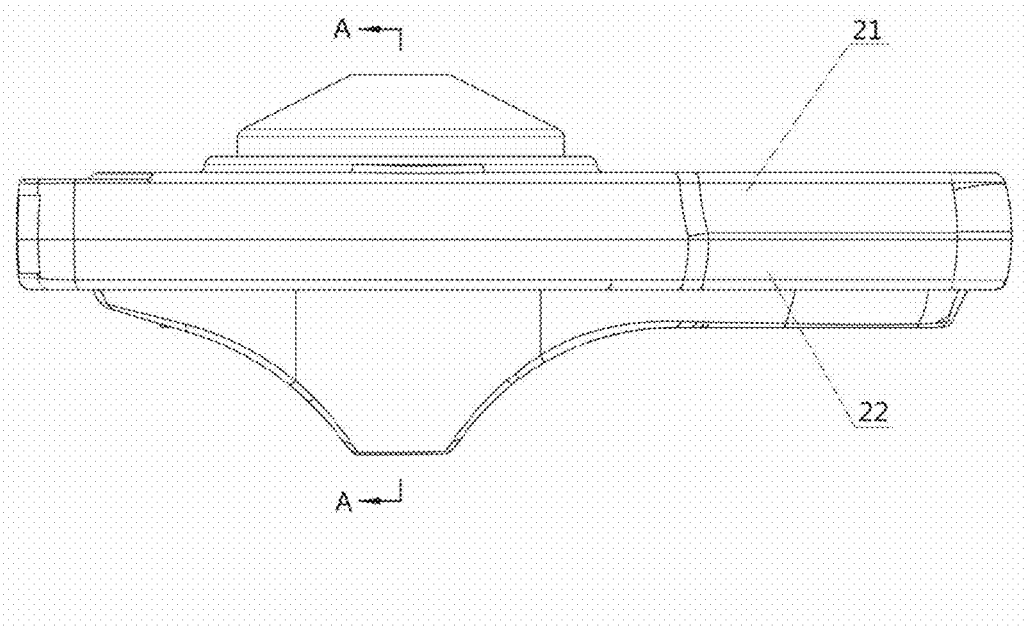
FIG. 2 is a front view of the pin-type anti-theft tag with double locking provided by the present invention.
Figure 3:
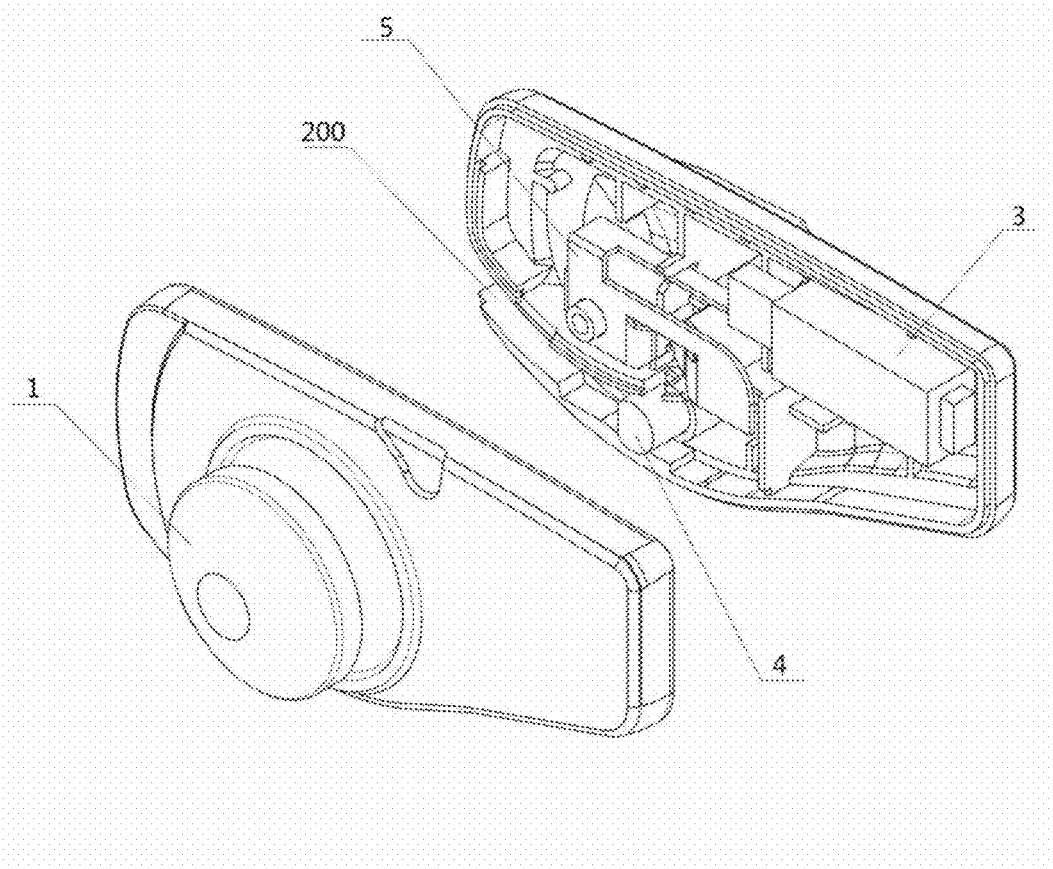
FIG. 3 is an internal schematic structural diagram of the pin-type anti-theft tag with double locking provided by the present invention.
Figure 4:
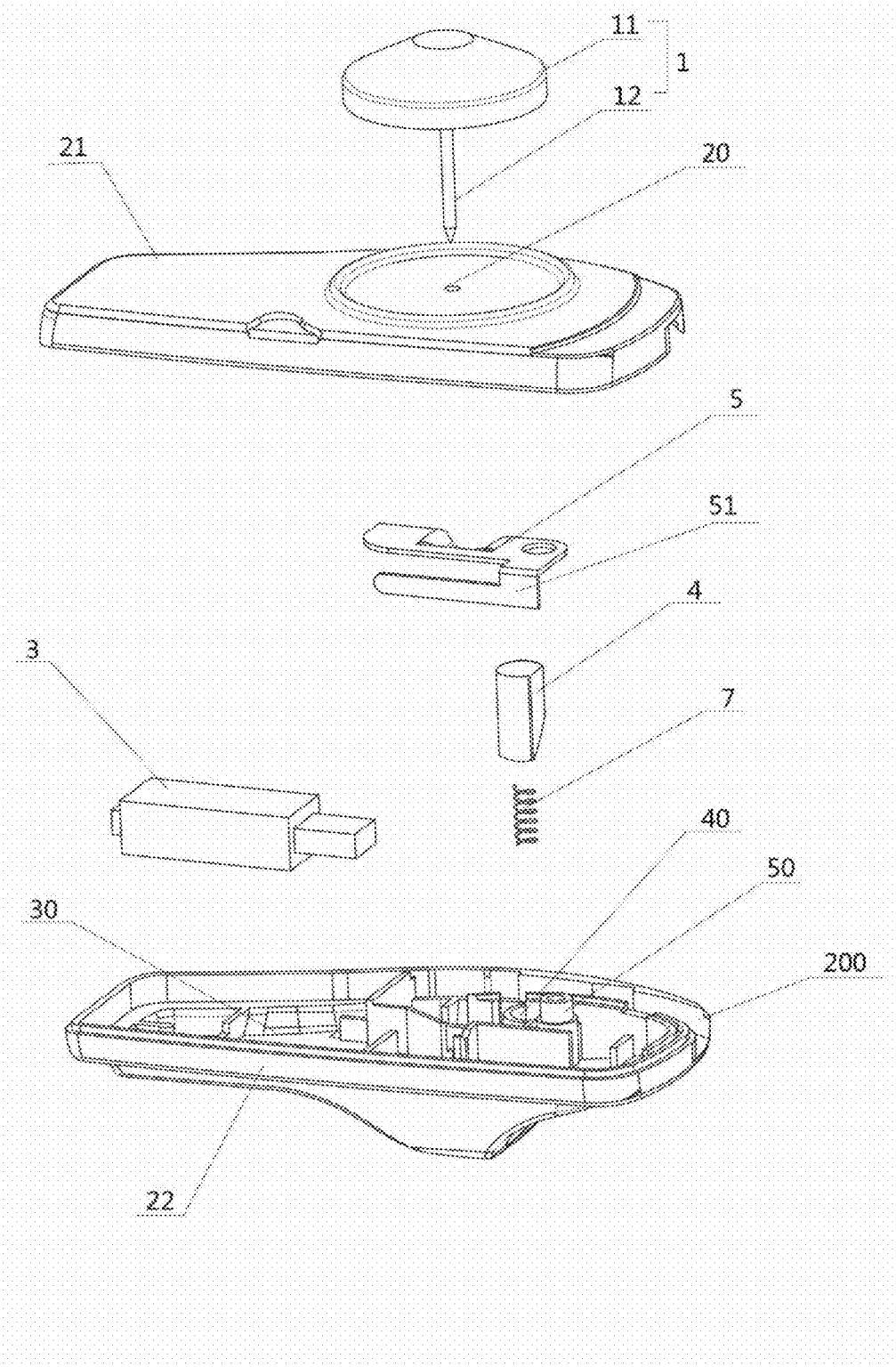
FIG. 4 is an exploded view of the pin-type anti-theft tag with double locking provided by the present invention.

The embodiments of the present invention will be explained by specific embodiments below. Those familiar with this art can easily understand other advantages and effects of the present invention from the contents disclosed in this specification. Apparently, the described embodiments are some, but not all of the embodiments of the present invention. Based on the embodiments of the present invention, all other embodiments obtained by those of ordinary skills in the art without going through any creative work shall fall within the protection scope of the present invention.

As shown in FIG. 1 to FIG. 4, a pin-type anti-theft tag with double locking includes a safety pin 1, a tag body 2 and a sensor 3. The sensor may be freely selected from an RFID sensor, an RF sensor, an AM sensor, an EM sensor and a combination thereof. The tag body 2 is provided with a tag hole 20 for inserting the safety pin 1 and an unlocking hole 200 for unlocking. A first lock body 4 and a second lock body 5 are mounted in the tag body 2.

To prevent the safety pin 1 from hurting people during use, the safety pin 1 includes a pin cap 11 and a pin rod 12, one end of the pin rod 12 is connected with the pin cap 11, and the other end of the pin rod 12 is inserted into the tag hole 20. The pin cap 11 can effectively prevent the pin rod 12 from hurting a human body, and meanwhile, can also enlarge a stress surface of the pin rod 12, which is convenient for pulling out the pin rod 12.

To detach and mount the tag body 2 conveniently, the tag body 2 includes an upper shell 21 and a lower shell 22 fastened together. The tag hole 20 is arranged on the upper shell 21.

To stably mount the first lock body 4 in the tag body 2, the lower shell 22 is provided with a sensor containing groove 30 for placing the sensor 3.

To stably mount the sensor 3 in the tag body 2, the lower shell 22 is provided with a first lock body containing groove <40> for placing the first lock body 4.

To stably mount the second lock body 5 in the tag body 2, the lower shell 22 is provided with a mounting column 50 for mounting the second lock body 5.

Figure 5:
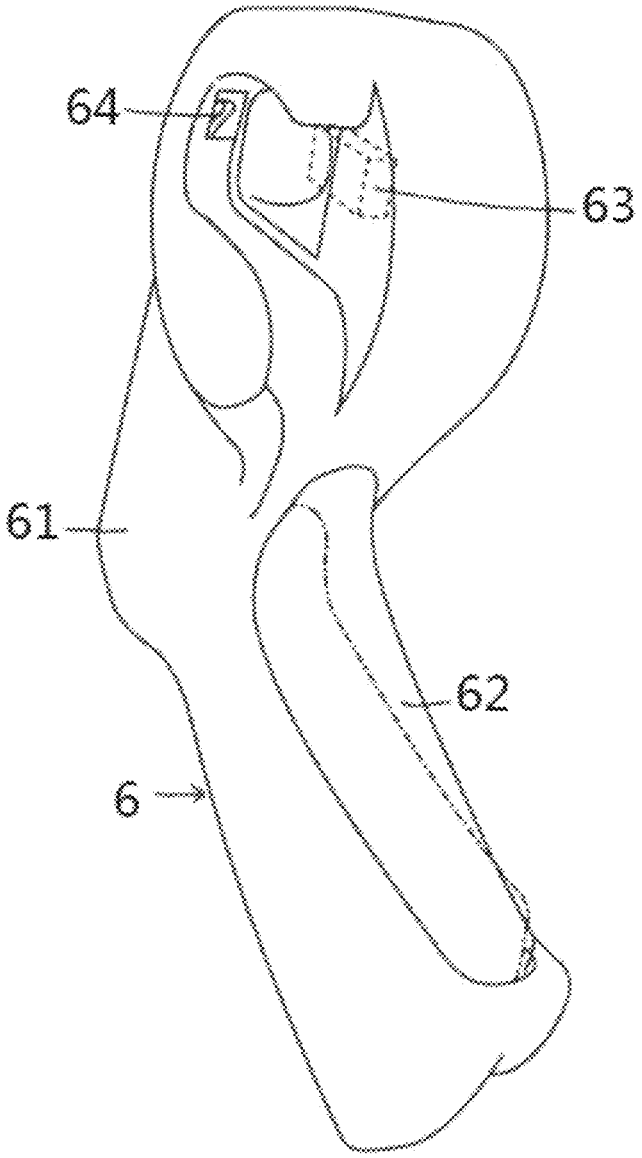
FIG. 5 is a schematic three-dimensional structural diagram of a detaching device provided by the present invention.
Figure 6:
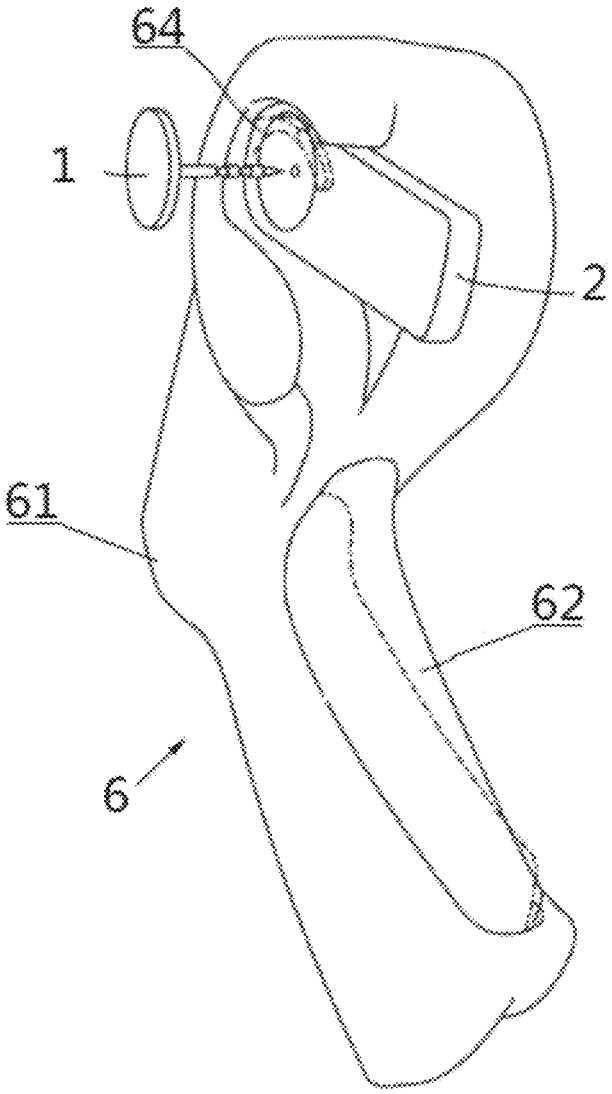
FIG. 6 is a diagram showing cooperative use of the pin-type anti-theft tag and a detaching device provided by the present invention.

The use principle of the pin-type anti-theft tag of the present invention is that the tag can be fixed on a commodity only by directly passing the safety pin 1 through the commodity (such as cloth, clothing, etc.) and then inserting the safety pin 1 into the tag hole 20 of the tag body 2. If someone takes away the commodity without permission and passes through an entrance of a shopping mall, a detecting electromagnetic wave of an alarm device disposed at the entrance of the shopping mall is disturbed by the sensor 3 in the tag, thus starting to send out an alarm signal. When the pin-type anti-theft tag needs to be detached from the commodity, the pin-type anti-theft tag of the present invention needs to be used in cooperation with a detaching device 6 shown in FIG. 5 and FIG. 6, so that the first lock body 4 and the second lock body 5 are in a release position at the same time, and the safety pin 1 is detached from the tag body 2.

Specifically, the detaching device 6 includes a holding portion 61, a pressing portion 62, a first detaching device 63 (illustrated by a dotted line) and a second detaching device 64. Specifically, the first detaching device 63 is a magnet, and the second detaching device 64 is an arched hook.

Figure 7:
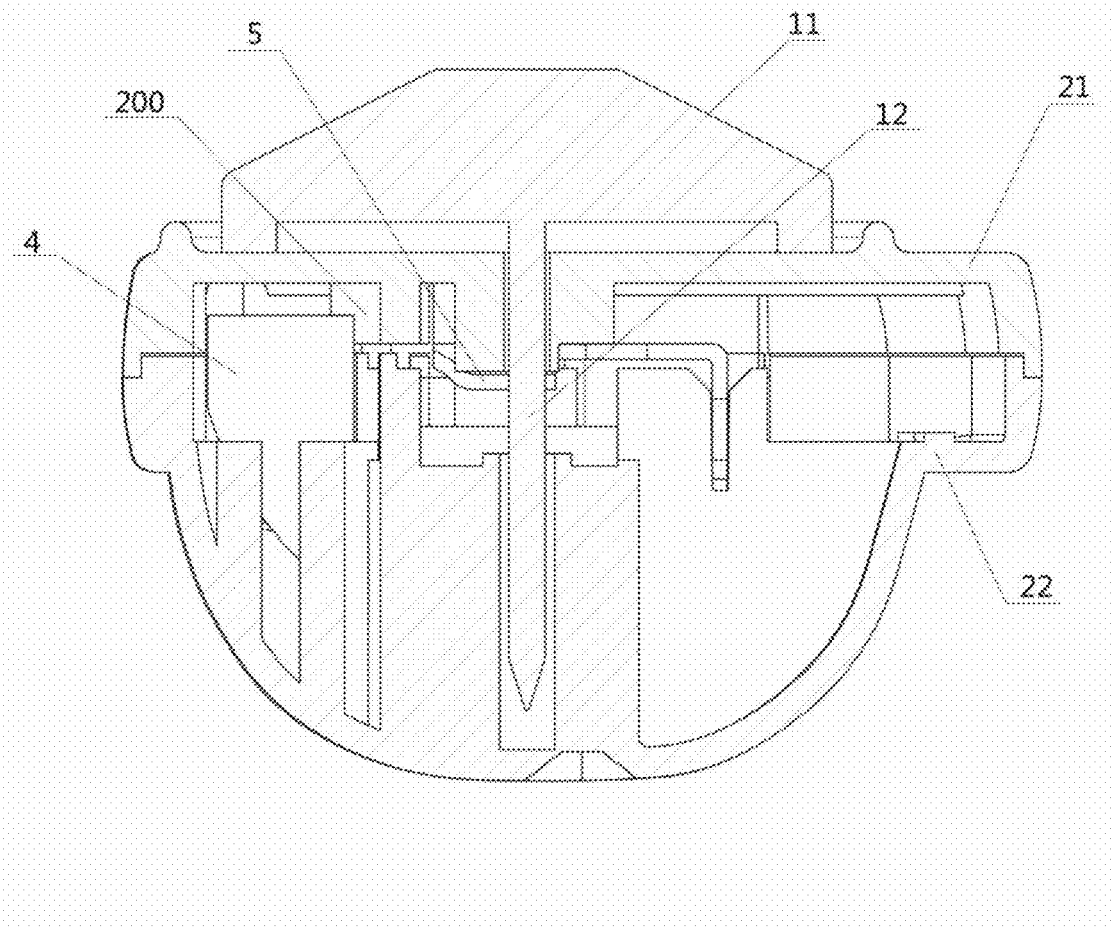
FIG. 7 is a sectional view of A-A provided in FIG. 2 of the present invention.

The first lock body 4 in the tag body 2 is an iron lock retainer. A spring lock retainer 7 is arranged below the lock retainer, which needs to be released by the first detaching device 63. The lock retainer is arranged at the unlocking hole 200 of the tag body 2. As shown in FIG. 7, the lock retainer will block the unlocking hole 200 when engaged. When the magnet is in a releasing position, the lock retainer is positioned to approach the magnet, and the spring lock retainer 7 is elastically deformed to release the unlocking hole 200. When the magnet is not in the release position, the lock retainer is reset under an action of the spring lock retainer 7 to block the unlocking hole 200.

The second lock body 5 is located in the tag body 2. The second lock body 5 is a spring lock with a release arm, which is selected from a spring lock of U.S. Pat. No. 5,425,419 issued to Nguyen et al. on Jun. 20, 1995. The spring lock includes a release arm 51, where the release arm 51 moves the spring lock from an engaged position to the release position when a pressure is applied. Specifically, the spring lock is released by the above-mentioned arched hook. The spring lock is aligned with the tag hole 20, and the spring lock locks the safety pin 1 when engaged. When the unlocking hole 200 is released, the arched hook passes through the unlocking hole 200, is located in the release position, and positions the release arm 51. The pressing portion 62 responds, and the arched hook triggers the release arm 51 to release the safety pin 1.

Although the present invention has been described above in detail with reference to general description and specific embodiments, some modifications or improvements can be made on the basis of the present invention, which is apparent to those skilled in the art. Therefore, these modifications or improvements made without departing from the spirit of the present invention shall fall within the protection scope of the present invention.

What is claimed is:

1. A pin-type anti-theft tag with double locking, comprising a safety pin;

a tag body;

a tag hole suitable for inserting the safety pin;

a sensor;

a first lock body, wherein the first lock body is located in the tag body and is released by a first detaching device, the first lock body is arranged at an unlocking hole of the tag body, and the first lock body blocks the unlocking hole when engaged, and positions and releases the unlocking hole when the first detaching device is in a release position; and a second lock body, wherein the second lock body is located in the tag body and is released by a second detaching device, the second lock body is an elastic lock, the second lock body is aligned with the tag hole, and the second lock body locks the safety pin when engaged, and positions and releases the safety pin when the second detaching device is in a release position, wherein when both the first lock body and the second lock body are located in the release position at the same time, the safety pin is allowed to be removed from the tag body.

2. The pin-type anti-theft tag with double locking according to claim 1, wherein the safety pin comprises a pin cap and a pin rod, a first end of the pin rod is connected with the pin cap, and a second end of the pin rod is inserted into the tag hole.

3. The pin-type anti-theft tag with double locking according to claim 1, wherein the sensor is one selected from the group of an RFID sensor, an RF sensor, an AM sensor, an EM sensor or a combination of the RFID sensor, the RF sensor, the AM sensor, the EM sensor.

4. The pin-type anti-theft tag with double locking according to claim 1, wherein the tag body comprises an upper shell and a lower shell fastened together; and the tag hole is arranged on the upper shell.

5. The pin-type anti-theft tag with double locking according to claim 4, wherein the lower shell is provided with a sensor containing groove for placing the sensor.

6. The pin-type anti-theft tag with double locking according to claim 4, wherein the lower shell is provided with a first lock body containing groove for placing the first lock body.

7. The pin-type anti-theft tag with double locking according to claim 4, wherein the lower shell is provided with a mounting column for mounting the second lock body.

8. The pin-type anti-theft tag with double locking according to claim 1, wherein the first lock body is an iron lock retainer; and a spring lock retainer is arranged below the iron lock retainer.

9. The pin-type anti-theft tag with double locking according to claim 1, wherein the second lock body is a spring lock with a release arm.

* * * * *